US005353774A

United States Patent [19]

Furuya

[11] Patent Number: 5,353,774

[45] Date of Patent: Oct. 11, 1994

[54] DAMAGE PREVENTING METHOD AND DEVICE FOR SENSOR ELEMENT OF AIR/FUEL RATIO SENSOR WITH HEATER

[75] Inventor: Junichi Furuya, Isesaki, Japan

[73] Assignee: Unisia Jecs Corporation, Atsugi, Japan

[21] Appl. No.: 24,178

[22] Filed: Feb. 22, 1993

[30] Foreign Application Priority Data

Feb. 20, 1992 [JP] Japan ..... 4-007148[U]

[51] Int. Cl.[5] ..... F02D 41/14

[52] U.S. Cl. ..... 123/685; 123/697

[58] Field of Search ..... 123/685, 686, 697; 204/406, 425

[56] References Cited

U.S. PATENT DOCUMENTS 4,655,182 4/1987 Nakano et al. ..... 123/697 X

FOREIGN PATENT DOCUMENTS 58-72647 4/1983 Japan .

6038 1/1985 Japan ..... 123/697

60-240840 11/1985 Japan .

63-51273 4/1988 Japan .

32044 2/1989 Japan ..... 123/697

*Primary Examiner*—Tony M. Argenbright

*Attorney, Agent, or Firm*—Foley & Lardner

[57] ABSTRACT

In an internal combustion engine, an air/fuel ratio senator containing a heater for promoting activation of a sensor element is constituted such that turning-on and heating by the heater is started only after a deviation of an output of the air/fuel ratio sensor becomes more than a predetermined value after starting of the engine. Therefore, forced heating by the heater begins only after moisture in the exhaust adhering to the sensor element is made to fully evaporate by exhaust heat, thereby preventing damage on the sensor element. The damage would be caused by thermal shock due to a difference in the temperature between the inner and the outer surfaces of the sensor element due to forced heating of the moisture.

4 Claims, 4 Drawing Sheets

DAMAGE PREVENTING METHOD AND DEVICE FOR SENSOR ELEMENT OF AIR/FUEL RATIO SENSOR WITH HEATER

BACKGROUND OF THE INVENTION

1. Field of the Invention

The present invention relates to a technique to prevent damage on a sensor element by thermal shock in an air/fuel ratio sensor which is used for detecting an air/fuel ratio in air/fuel ratio feedback control for an internal combustion engine and is provided with a heater for promoting activation of the sensor element.

2. Related Art of the Invention

There is an electronically controlled fuel injection device for an internal combustion engine which is so constituted that an air/fuel ratio of an engine intake mixture is detected based on a concentration of a specific component such as oxygen in exhaust gas and feedback control of a fuel injection amount is carried out so that the air/fuel ratio gets close to a theocratical air/fuel ratio (See The Japanese Unexamined Patent Publication No. 60-240840 etc.).

As an air/fuel ratio sensor used for the above air/fuel ratio feedback control, there have been used such a sensor that electrodes are formed each on inner and outer surfaces of a zirconia (oxygen ion conductive solid electrolyte) tube as a sensor element, an electromotive force is generated between the above electrodes corresponding to a ratio between an oxygen concentration (reference oxygen concentration) in the air introduced into the inside of the tube and the oxygen concentration in the exhaust gas on the outside, and by monitoring this electromotive force, not only the oxygen concentration in the exhaust gas but also rich/lean against the theoretical air/fuel ratio in the engine intake mixture is detected (See The Japanese Unexamined Utility Model Publication No. 63-51273, etc.), and another sensor that the theoretical air/fuel ratio is detected using a change in a resistance value caused by the oxygen concentration (oxygen partial pressure) of a transition metal oxide such as titania as a sensor element.

Also, as the above sensor element is not fully activated at a low temperature and can not favorably detect the air/fuel ratio, there are those with a built-in electric heater for forcibly heating the sensor element to promote activation before warming up when an exhaust temperature is low.

The above sensor element is usually provided at a collection part of an exhaust manifold, but there are those which have another air/fuel ratio sensor in the same structure at the lower stream side of a CCRO for exhaust purification provided in an exhaust system other than the above air/fuel ratio sensor and carry out feedback control of the air/fuel ratio using those two air/fuel ratio sensors (See The Japanese Unexamined Patent Publication No. 58-72647, etc.).

As shown in FIG. 7 and FIG. 8 when an engine is started after cooling down, an exhaust temperature is raised and then, temperature of a catalyzer 1 and an exhaust pipe 2 are raised with some delay.

Water content ($H_2O$) is generally included in the exhaust as vapor, and as shown in FIG. 7, the exhaust is cooled in the exhaust pipe 2 provided away from the exhaust manifold 3 to below a dew-point temperature and moisture is generated and adheres to the surface.

Particularly as reaction of unburnt gas is promoted by the catalyzer, an amount of moisture included in the exhaust is large at the lower stream side of the catalyzer 1, and in the air/fuel ratio feedback control system provided with oxygen sensors 4*a* and 4*b* each at an upper and a lower stream sides of the CCRO, a large amount of water is generated around an element of the oxygen sensor 4*b* mounted on the lower stream side of the catalyzer 1.

Therefore, in the oxygen sensor 4*b* on the lower stream side of the catalyzer 1, a large amount of moisture in the exhaust adheres to the sensor element (zirconia tube, etc.) with starting of the engine, and when the sensor element is heated by turning on the above heater with the moisture left on the element, the moisture evaporates from the sensor element surface. Then, it might cause a problem that a difference in the temperature between inside and outside of the sensor element such as zirconia and titania is widened and the ceramic element of the above oxygen sensor 4*b* is split by thermal shock.

SUMMARY OF THE INVENTION

The present invention was made in view of the aforementioned problems and the object of the present invention is to prevent thermal shock caused by adhesion of moisture in the exhaust to a sensor element and to prevent damage on the sensor element by shifting a timing of heating by a heater for activating the sensor element.

Therefore, a damage preventing method and device for a sensor element of an air/fuel ratio sensor with heater according to the present invention is, in an air/fuel ratio sensor provided facing to an exhaust passage of an internal combustion engine and comprising a sensor element whose output value is changed in response to a concentration of a specific component in exhaust changed by an air/fuel ratio in an engine intake mixture and an electric heater for promoting activation of the sensor element at a low temperature by heating the above sensor element, a damage preventing method for the sensor element of the air/fuel ratio sensor with heater in which a state where a deviation of the above air/fuel ratio sensor output becomes more than a predetermined value after starting of the engine is detected and the above heater is turned on after detecting the above state, or a damage preventing device for the sensor element of the air/fuel ratio sensor with heater provided with a sensor output state detecting means for detecting a state where the deviation of the above air/fuel ratio sensor output becomes more than the predetermined value after starting of the engine and a heater electricity control means for turning on the above heater after detecting the state where the deviation of the above air/fuel ratio sensor output becomes more than the predetermined value.

With the above constitution, heating timing of the sensor element is delayed by turning on the heater after detecting the state where the deviation of the above air/fuel ratio sensor output becomes more than the predetermined value since the engine is started. Then, the sensor element is heated by the heater after moisture which was generated by rise in the exhaust temperature and adheres to the sensor element is made to fully evaporate, which can prevent damage on the sensor element caused by excessive difference in the temperature between the inner and the outer surfaces of the sensor element by forced heating of the moisture by the heater.

Also, detection of the state where the deviation of the above air/fuel ratio sensor output becomes more than the predetermined value can be made by directly detecting the output of the air/fuel ratio sensor, which enables detection with high accuracy.

Or, the detection of the state where the deviation of the above air/fuel ratio sensor output becomes more than the predetermined value can be made by measuring an elapsed time since starting, and it can be assumed that the deviation of the air/fuel ratio sensor output becomes more than a predetermined value by an exhaust heat when the elapsed time becomes more than the predetermined value.

The objects of the present invention will be mode clear in the following explanation on preferred embodiments by referring to the attached drawings.

PREFERRED EMBODIMENTS.

Preferred embodiments of the present invention will be hereinafter described.

Figure 1:
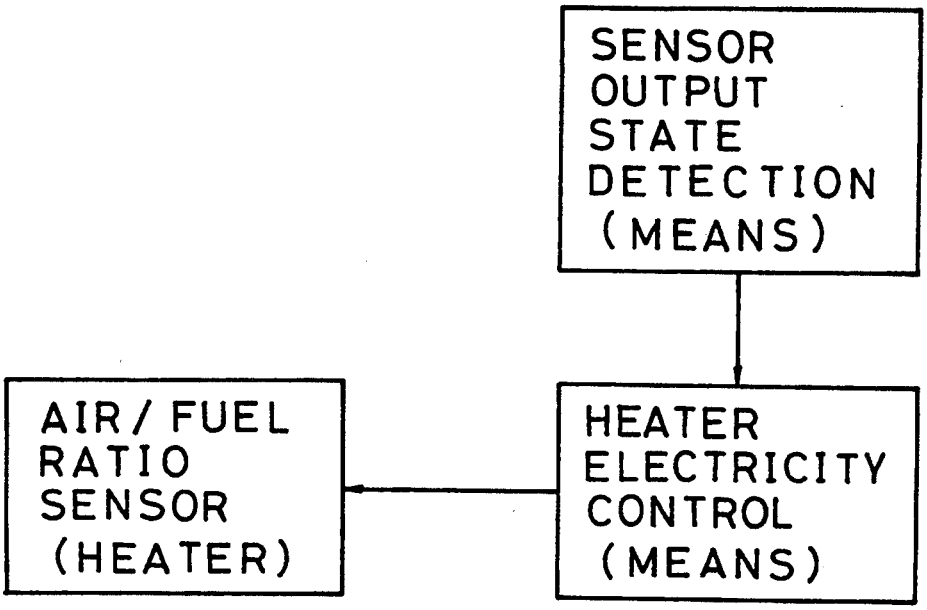
FIG. 1 is a block diagram showing the basic constitution of the present invention.
Figure 2:
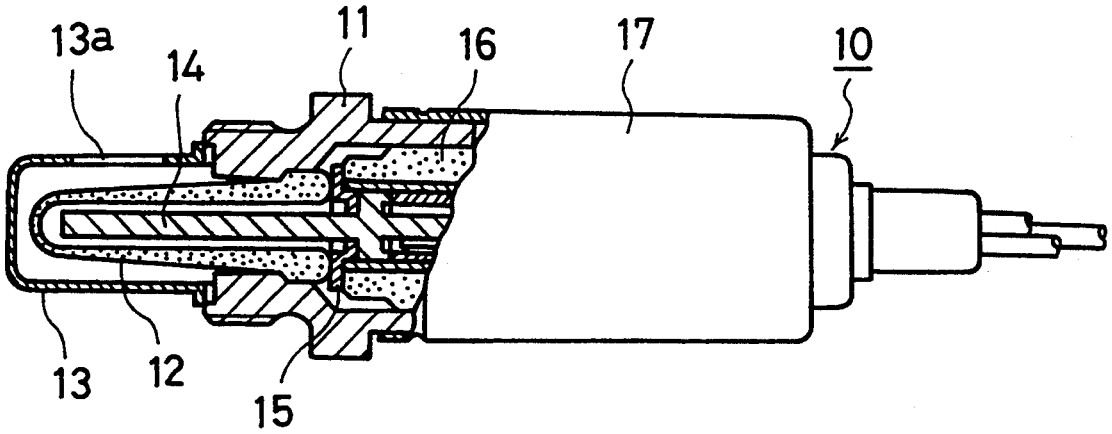
FIG. 2 is a partial sectional showing an air/fuel ratio sensor according to a preferred embodiment of the present invention.

FIG. 2 shows the structure of an air/fuel ratio sensor 10 of a zirconia tube type, and a zirconia tube 12 as a sensor element is held at a tip end of a holder 11 which is covered by a protector 13 with a slit 13*a*. Electrodes made of platinum and so on are formed each on the inner and the outer surfaces of the above zirconia tube. Also, a ceramic heater 14 in the rod state is arranged projecting into the inside space of the zirconia tube 12. The above ceramic heater 14 is to heat and activate the zirconia tube 12 by electricity at a low exhaust temperature so as to obtain required output characteristics.

There are also arranged a metal contact plate 15 which is electrically connected to the above inside electrode by being brought into contact with a tip end face on the opening side of the above zirconia tube 12, and an isolation bush 16 which presses the above contact plate 15 onto the zirconia tube 12 and through which a lead wire for taking out the output of the zirconia tube 12 and a lead wire for turning on the above ceramic heater 14 pass. The outer periphery of the above holder 11 is covered by a cap 17.

The above air/fuel ratio sensor 10 is placed with the portion of the zirconia tube 12 covered by the above protector 13 facing into the exhaust pipe of the engine and generates an electromotive force according to the ratio between the reference oxygen concentration in the air inside the zirconia tube 12 and the oxygen (specific component in the exhaust) concentration in the exhaust outside the tube.

In other words, the above air/fuel ratio sensor 10 is an air/fuel ratio sensor whose output value is changed in response to the oxygen concentration in the exhaust, and it detects rich/lean against the theoretical air/fuel ratio using the fact that the oxygen concentration in the exhaust is rapidly changed on the border of the theoretical air/fuel ratio. It is so constituted that the above electromotive force is taken out of the platinum electrodes provided on the inner and the outer surfaces of the zirconia tube 12.

Figure 3:
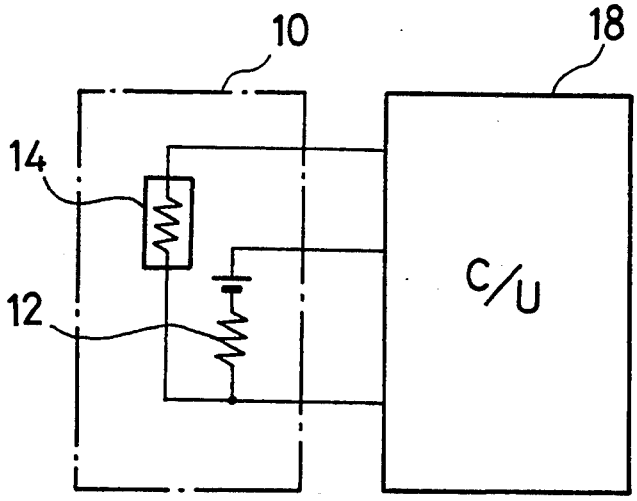
FIG. 3 is a schematic diagram of a heater electricity control device in the above air/fuel ratio sensor.

And the output of this air/fuel ratio sensor 10 is, as shown in FIG. 3, put into a control unit 18 for electronic control of a fuel supply amount to the internal combustion engine, and the control unit 18 with a built-in micro computer feedback-corrects a fuel injection amount by a fuel injection valve (not shown) so that the air/fuel ratio of the engine intake mixture detected by the output value from the above air/fuel ratio sensor 10 gets close to the target air/fuel ratio (theoretical air/fuel ratio).

Figure 4:
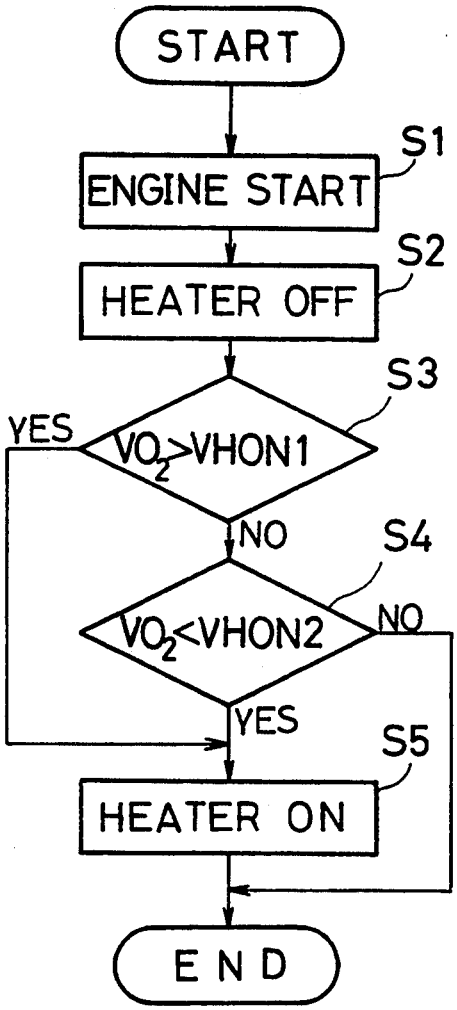
FIG. 4 is a flowchart showing a heater electricity control by the above device.

Also, the control unit 18 has a function of on/off control of the ceramic heater 14 of the air/fuel ratio sensor 10 so that, as shown in FIG. 4, when a predetermined time has elapsed since the engine is started and the heater 14 is turned off and a deviation of the output value of the air/fuel ratio sensor 10 is increased in the air/fuel ratio feedback control to more than a first reference value or less than a second reference value, the heater 14 is turned on to heat the element so as to delay heating timing.

Figure 5:
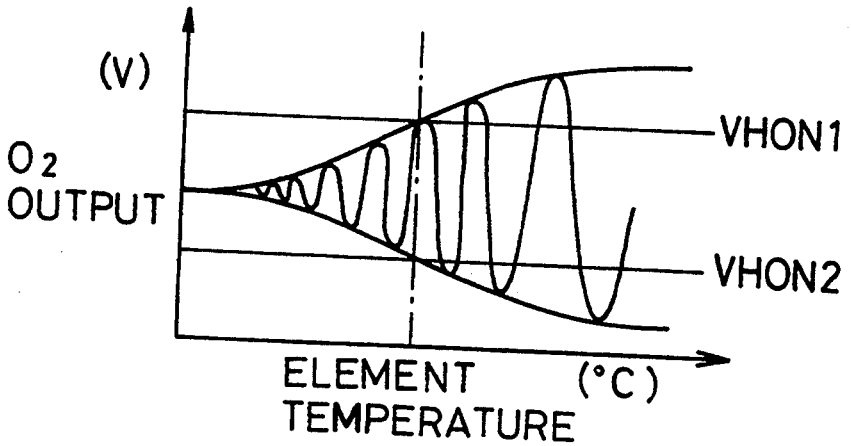
FIG. 5 is a diagram showing a relation between an output value of the air/fuel ratio sensor and a sensor element temperature.

In FIG. 5, the first reference value of the output value of the air/fuel ratio sensor 10 is shown as VHON1 and the second reference value as VHON2, that is, VHON1 is set as the maximum output level from the air/fuel ratio sensor and VHON2 is set as the minimum output level from the air/fuel ratio sensor 10 when the temperature of the air/fuel ratio sensor 10 is raised to the extent that the moisture adhered to the air/fuel ratio sensor is made to evaporate. When the air/fuel ratio sensor is fully activated after the temperature of the air/fuel ratio sensor is raised, VHON1 is less than the maximum output level from the air/fuel sensor 10 and VHON2 is more than the minimum output level from the air/fuel ratio sensor 10. And it is so constituted that the heater 14 is turned on in the state where, after starting the engine, the deviation of the output value of the air/fuel ratio sensor 10 is increased in the air/fuel ratio feedback control to more than the first reference value or less than the second reference value.

Next, the internal processing will be described according to the flowchart of FIG. 4. First, at Step 1 (hereinafter referred to as "S1"), the engine is started and at S2, the heater 14 is turned off.

At S3, it is judged whether the output value (V02) of the air/fuel ratio sensor 10 exceeds the first reference value (VHON1) or not, and if it is equal to or less than the first reference value (VHON1), the program goes on to S4, while if it exceeds the first reference value (VHON1), the heater is turned on at S5.

At S4, it is judged whether the output value (V02) of the air/fuel ratio sensor 10 falls below the second reference value (VHON2), the turned-off state of the heater 14 is maintained, while if it is equal to or more than the second reference value (VHON2), the turned-off state of the heater 14 is maintained, while if it falls below the second reference value (VHON2), the heater is turned on at S5.

By this, when the predetermined time has elapsed since starting of the engine and the output value of the air/fuel ratio sensor 10 exceeds the first reference value or falls below the second reference value, it is assumed that the temperature of the air/fuel ratio sensor 10 is raised to the extent that all the moisture is made to evaporate by exhaust heat, and the heater 14 is turned on. Thus, the zirconia tube 12 as the sensor element can be heated by the heater 14 after all the moisture is made to evaporate by exhaust heat, which prevents damage (split) of the zirconia tube 12 by thermal shock that the difference in the temperature of the inner and the outer surfaces of the zirconia tube 12 becomes excessive due to forced heating of the moisture.

Figure 6:
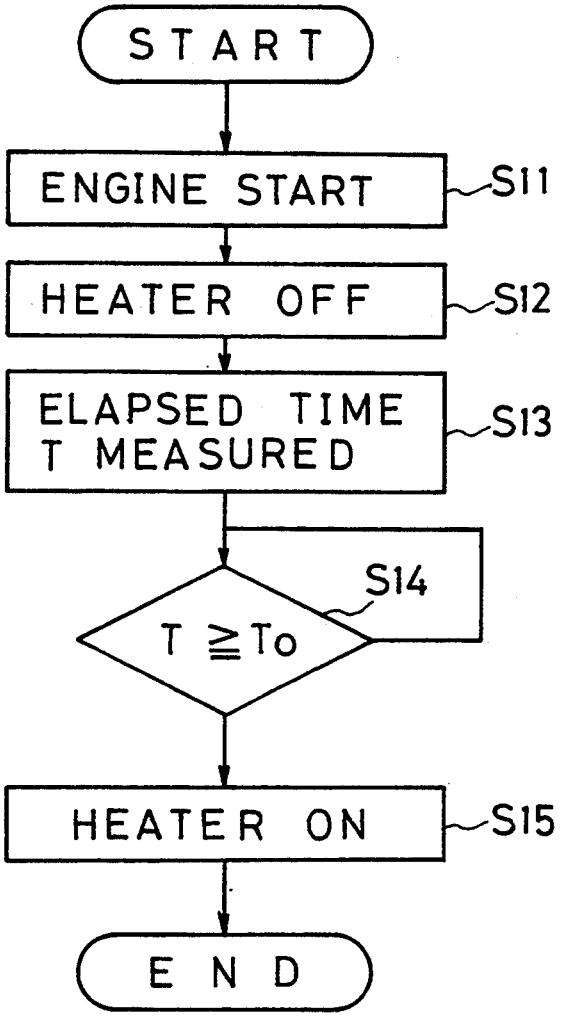
FIG. 6 is a flowchart showing heater electricity control according to a second preferred embodiment of the present invention.
Figure 7:
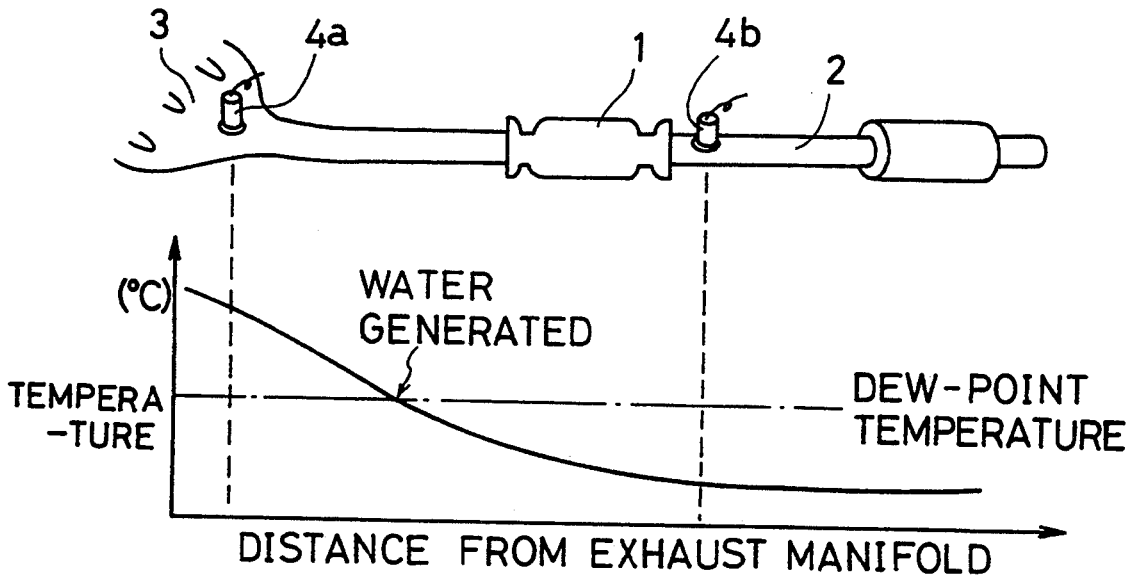
FIG. 7 is a diagram showing temperature distribution of an air/fuel ratio feedback control device using two air/fuel ratios and its exhaust system.
Figure 8:
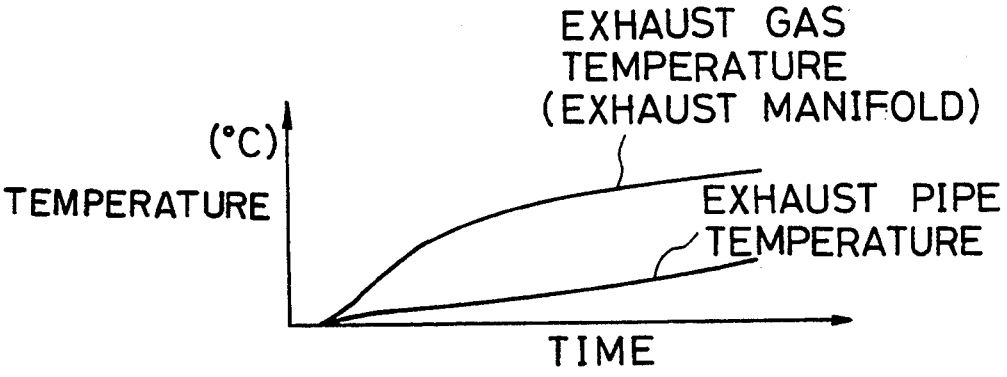
FIG. 8 is a diagram showing change in temperature rise of each part after starting from cooling down.

Next, a second preferred embodiment will be hereinafter described according to the flowchart of FIG. 6.

Steps 11 and Steps 12 are the same as Steps 1 and Steps 2 in FIG. 4.

At Steps 13, an elapsed time after starting of the engine is measured by a software timer or the like of CPU built in the control unit 18.

And at Steps 14, it is judged whether the measured elapsed time after starting of the engine has reached a predetermined time TO or not, and if it has, the program goes on to Steps 15 to turn on the heater 14 to start heating.

In this preferred embodiment, the above predetermined time TO is set by experimentally obtaining in advance a relation between an elapsed time since starting from cooling down and a deviation of the air/fuel ratio sensor output.

The above constitution is particularly effective for the air/fuel ratio sensor 10 provided on the lower stream side of the catalyzer for exhaust purification since its moisture amount in the exhaust is larger than that on the catalyzer upper stream side due to reaction of an unburnt component in the above catalyzer. But even the air/fuel ratio sensor 10 provided on the catalyzer upper stream side may be so constituted that the timing to heat the heater after starting of the engine is delayed.

Though the explanation has been made on the preferred embodiment with zirconia tube type air/fuel ratio sensor 10, the sensor may be such a type that titania is used as a sensor element and a heater wire is buried between laminated substrates. Type and structure of the air/fuel ratio sensor is not limited, and those which respond to an exhaust component other than the oxygen concentration may be used. But it is particularly effective to delay the timing to heat the heater after starting the engine as above for the air/fuel ratio sensor using ceramics such as zirconia or titania as a sensor element.

As mentioned above, according to the present invention, it is made possible to heat the element by the heater after all the moisture evaporates and to prevent thermal shock due to adhesion of the moisture in the exhaust to the element of the air/fuel ratio sensor, whereby split of the element in the sensor element of the air/fuel ratio sensor can be prevented.

I claim:

1. A damage preventing method for a sensor element of an air/fuel ratio sensor with heater wherein an air/fuel ratio sensor is provided facing an exhaust passage of an internal combustion engine and comprises a sensor element whose output value is changed in response to a concentration of a specific component in exhaust changed by an air/fuel ratio in an engine intake mixture and an electric heater for promoting activation of the sensor element at a low temperature by heating the sensor element, a state where a deviation of the air/fuel ratio sensor output becomes more than a predetermined value after starting of the engine is detected by detecting the output of the air/fuel ratio sensor; and the heater is turned on after detecting the state.

2. A damage preventing method for a sensor element of an air/fuel ratio sensor with heater wherein an air/fuel ratio sensor is provided facing an exhaust passage of an internal combustion engine and comprises a sensor element whose output value is changed in response to a concentration of a specific component in exhaust changed by an air/fuel ratio in an engine intake mixture and an electric heater for promoting activation of the sensor element at a low temperature by heating the sensor element, a state where a deviation of the air/fuel ratio sensor output becomes more than a predetermined value after starting of the engine is detected by measuring an elapsed time after starting of the engine; and the heater is turned on after detecting the state.

3. A damage preventing device for a sensor element of an air/fuel ratio sensor with heater comprising:

an air/fuel ratio sensor facing an exhaust passage of an internal combustion engine, the air/fuel ratio sensor including a sensor element whose output value is changed in response to a concentration of a specific component in exhaust changed by an air/fuel ratio in an engine intake mixture, and an electric heater for promoting activation of the sensor element at a low temperature by heating the sensor element, a sensor output state detecting means for detecting a state where a deviation of the air/fuel ratio sensor output becomes more than a predetermined value after starting of the engine by detecting the output of the air/fuel ratio sensor; and a heater electricity control unit for turning on the heater after detecting the state when the deviation of the air/fuel ratio sensor output becomes more than the predetermined value.

4. A damage preventing device for a sensor element of an air/fuel ratio sensor with heater comprising:

an air/fuel ratio sensor facing an exhaust passage of an internal combustion engine, the air/fuel ratio sensor including a sensor element whose output value is changed in response to a concentration of a specific component in exhaust changed by an air/fuel ratio in an engine intake mixture, and an electric heater for promoting activation of the sensor element at a low temperature by heating the sensor element, a sensor output state detecting means for detecting a state where a deviation of the air/fuel ratio sensor output becomes more than a predetermined value after starting of the engine by measuring an elapsed time after starting of the engine; and a heater electricity control unit for turning on the heater after detecting the state when the deviation of the air/fuel ratio sensor output becomes more than the predetermined value.

* * * * *